US010365028B2

(12) United States Patent
Kawabata

(10) Patent No.: US 10,365,028 B2
(45) Date of Patent: Jul. 30, 2019

(54) VENDING MACHINE

(71) Applicant: FUJI ELECTRIC CO., LTD., Kawasaki-shi (JP)

(72) Inventor: Keisuke Kawabata, Yokkaichi (JP)

(73) Assignee: FUJI ELECTRIC CO., LTD., Kawasaki-shi (JP)

( * ) Notice: Subject to any disclaimer, the term of this patent is extended or adjusted under 35 U.S.C. 154(b) by 509 days.

(21) Appl. No.: 15/068,016

(22) Filed: Mar. 11, 2016

(65) Prior Publication Data

US 2016/0334156 A1 Nov. 17, 2016

(30) Foreign Application Priority Data

May 11, 2015 (JP) ..... 2015-096642

(51) Int. Cl.

| | |
|---|---|
| ***F28D 1/047*** | (2006.01) |
| ***F28F 1/32*** | (2006.01) |
| ***F28F 21/08*** | (2006.01) |
| ***F25D 23/00*** | (2006.01) |
| ***F28F 19/00*** | (2006.01) |
| ***F25B 39/00*** | (2006.01) |

(Continued)

(52) U.S. Cl.

CPC ..... *F25D 23/006* (2013.01); *F25B 39/00* (2013.01); *F25B 39/04* (2013.01); *F28D 1/0476* (2013.01);

(Continued)

(58) Field of Classification Search

CPC .... F25D 23/006; F25D 23/003; F25D 23/067; F25D 2323/00; F25D 19/00; F25B 39/04;

(Continued)

(56) References Cited

U.S. PATENT DOCUMENTS 5,348,079 A * 9/1994 Tanaka ..... F28F 9/002 165/67
6,513,579 B1 * 2/2003 Kent ..... F28F 9/002 165/67

(Continued)

FOREIGN PATENT DOCUMENTS

JP 2001-116428 A 4/2001
JP 3206681 B2 * 9/2001

(Continued)

OTHER PUBLICATIONS

Japan Patent Office, "Office Action for Japanese Patent Application No. 2015-096642," dated Feb. 27, 2019.

*Primary Examiner* — Frantz F Jules
*Assistant Examiner* — Martha Tadesse
(74) *Attorney, Agent, or Firm* — Manabu Kanesaka

(57) ABSTRACT

A vending machine includes a vending machine main body, an internal heat exchanger, an external heat exchanger made of aluminum, and a compressor. The vending machine further includes an attachment base made of a steel plate and disposed on the base such that the external heat exchanger and the compressor are provided on the attachment base, and a pair of right and left holding members made of synthetic resin and engaging with and fixing to the attachment base, each having an accommodation unit corresponding to an outer shape at two sides of a lower portion of the aluminum external heat exchanger. The pair of right and left holding members forms a gap between the aluminum external heat exchanger and the attachment base such that the two sides of the lower portion of the aluminum external heat exchanger are accommodated and held in the accommodation units.

5 Claims, 7 Drawing Sheets

(51) Int. Cl.

| | |
|---|---|
| ***G07F 17/00*** | (2006.01) |
| ***F25B 39/04*** | (2006.01) |
| ***G07F 9/10*** | (2006.01) |
| ***F28F 1/12*** | (2006.01) |
| *F28D 21/00* | (2006.01) |

(52) U.S. Cl.
CPC ..... *F28D 1/0478* (2013.01); *F28F 1/126* (2013.01); *F28F 19/00* (2013.01); *F28F 21/084* (2013.01); *G07F 9/10* (2013.01); *G07F 17/0014* (2013.01); *F25D 2323/00284* (2013.01); *F28D 2021/007* (2013.01)

(58) Field of Classification Search
CPC . F25B 2500/12; F25B 2500/13; F28F 21/084; F28F 2280/06; F28F 9/001; F28F 9/002; F28F 2009/004; F28D 1/047; F28D 1/0471; F28D 1/0477; F28D 1/0478
See application file for complete search history.

(56) References Cited

U.S. PATENT DOCUMENTS

| | | | | |
|---|---|---|---|---|
| 6,701,739 | B2 * | 3/2004 | Morse | F25D 19/00 62/277 |
| 7,040,380 | B1 * | 5/2006 | O'Brien | F28F 9/002 165/149 |
| 2003/0230104 | A1 * | 12/2003 | Morse | F25D 19/00 62/277 |
| 2006/0207278 | A1 * | 9/2006 | Mead | A47F 3/0408 62/246 |
| 2010/0116461 | A1 | 5/2010 | Saito et al. | |
| 2014/0326434 | A1 * | 11/2014 | Farlow | F28F 9/007 165/67 |
| 2015/0323229 | A1 * | 11/2015 | Kim | F28B 1/0535 1/535 |

FOREIGN PATENT DOCUMENTS

| | | | | |
|---|---|---|---|---|
| JP | 3206681 | B2 | 9/2001 | |
| JP | 2010-112667 | A | 5/2010 | |
| JP | 2013-040733 | A | 2/2013 | |
| JP | 2013-139920 | A | 7/2013 | |
| WO | WO 2013122450 | A1 * | 8/2013 | F24F 1/16 |
| WO | WO-2013122450 | A1 * | 8/2013 | F24F 1/16 |
| WO | WO-2014183501 | A1 * | 11/2014 | F24F 1/46 |
| WO | WO 2015043676 | A1 * | 4/2015 | F28F 9/0132 |

* cited by examiner (a)

(b)

VENDING MACHINE

CROSS-REFERENCE TO RELATED APPLICATION

The application claims a priority of Japanese Patent Application No. 2015-096642 filed on May 11, 2015, the disclosure of which is incorporated herein.

BACKGROUND

Technical Field

The invention relates to a vending machine for keeping products such as a canned beverage in a heated (hot) or cooled (cold) state and selling the product, in which a refrigeration cycle is constituted by an internal heat exchanger provided inside of a vending machine main body formed as a heat-insulated housing, a condenser (external heat exchanger) provided outside of the vending machine main body, and a compressor.

Related Art

For example, a soft drink vending machine for selling products such as a canned beverage and a beverage in a PET bottle saves the products in a product accommodation chamber of a vending machine main body formed as a heat-insulated housing in such a state that the products are classified into cold and hot states, and the soft drink vending machine displays multiple product samples in a right/left direction in a display chamber of an outer door, and is configured to sell a product selected on the basis of an operation of a product selection button provided in association with the product sample. This kind of vending machine will be explained with reference to FIG. 7.

As shown in FIG. 7, this vending machine includes a vending machine main body 1, a front surface of which is open, and a single swinging outer door 2 supported in an openable manner with a hinge by one of the side walls at the front surface of the vending machine main body 1, and the vending machine main body 1 is formed as a heat-insulated housing so that a heat-insulated board made of urethane foam is provided along the inside of an external box made of steel plate. More specifically, the heat-insulated board is arranged on a top wall, right and left side walls, a back wall, and a bottom wall 1*a*. The product accommodation chamber enclosed by the heat-insulated board of the vending machine main body 1 is divided into multiple product accommodation chambers 3, 4, 5 in the right/left direction by heat-insulated division plates 1*b*. In this example, each of the product accommodation chambers 3, 4, 5 is provided with a meandering product accommodation path which is called serpentine method. At the lower end, a product accommodation rack R having a product discharge apparatus is accommodated and installed in each of the product accommodation chambers 3, 4, 5. At the lower portion of the product accommodation rack R, a product discharge chute 6, on which a product cut out by the product discharge apparatus slides or rolls, is provided in a forward-inclined posture. At the lower portion of the product discharge chute 6 and at the lower end of each of the product accommodation chambers, a cooling and heating unit is provided to save the products accommodated in the product accommodation rack R in cold or hot states by cooling or heating each of the product accommodation chambers. An inner door 7 is provided on the front surface of the vending machine main body 1. In this example, the inner door 7 is divided into the upper and lower parts, which include an upper inner door 7*a* and a lower inner door 7*b*. The lower inner door 7*b* is provided with a product discharge port having a discharge door 7*b*1 at a position opposite to the product discharge chute 6 feeding the product discharged from the product accommodation rack R of each of the product accommodation chambers 3, 4, 5. The upper end entrance of the discharge door 7*b*1 is axially supported, so that the discharge door 7*b*1 is hung to close the product discharge port by its own weight, thereby preventing the cold air or the warm air from flowing out. The discharge door 7*b*1 is formed so that the discharge door 7*b*1 is pushed open by the product discharged via the product discharge chute 6, and the product is fed to a product retrieval port 8 of the outer door 2.

The lower portion of the bottom wall 1*a* of the vending machine main body 1 is formed as a machine chamber 9. A condensing unit for a refrigerator is provided in this machine chamber 9. The refrigeration cycle is constituted by the condensing unit and the cooling unit of the cooling and heating unit provided in the product accommodation chambers 3, 4, 5. A product accommodation chamber having only the cooling unit provided therein is a cold-only chamber, and a product accommodation chamber having both of the cooling and heating units provided therein is a hot/cold switchable chamber. In the example as shown in FIG. 7, the product accommodation chambers 3, 4 are hot/cold switchable chambers, and the product accommodation chamber 5 is a cold-only chamber. An internal heat exchanger and an internal fan functioning as an evaporator for cooling the products are provided as the cooling unit in each of the product accommodation chambers 3, 4, 5. The internal heat exchanger is connected to the condensing unit of the refrigerator constituted by a compressor, a condenser (external heat exchanger), an external fan, and the like provided in the machine chamber. In addition to the heat exchanger, a heater for heating the products is provided as a heating unit in the product accommodation chambers 3, 4 which are the hot/cold switchable chambers. Instead of providing the heater, the internal heat exchanger provided in each of the product accommodation chambers 3, 4 may also be used as the heating unit. In this case, in addition to the circuit configuration for constituting the refrigeration cycle of the condensing unit of the refrigerator, the internal heat exchanger is provided with a refrigerant switch circuit for allowing the high temperature refrigerant gas from the compressor to flow into the condenser (external heat exchanger) of the condensing unit of the refrigerator via the internal heat exchanger, so that in the hot operation mode, the refrigerant switch circuit is formed to cause the internal heat exchanger of each of the product accommodation chambers 3, 4 to function as the condenser.

In this case, the condensing unit of the refrigerator provided in the machine chamber 9 of the vending machine main body 1 is fixed and attached to an attachment base made of a steel plate provided on the base forming the bottom portion of the machine chamber 9 (for example, Japanese Patent No. 3206681). In this case, a conventional condenser (external heat exchanger) employs a fin-and-tube heat exchanger. This fin-and-tube heat exchanger is constituted by U-bends and straight circular pipes where tubes forming the refrigerant flow path are straight, and the straight circular pipes are arranged in the vertical directions and fixed to the right and left rectangular end plates, and the U-bends are fixed to the right and left end portions of adjacent circular pipes, so that the refrigerant path meandering as a whole is formed. As described above, since the conventional condenser (external heat exchanger) has the right and left end plates, the condenser is installed on the attachment base by using the right and left end plates.

Prior Art

Japanese Patent No. 3206681

Tubes of the conventional fin-and-tube heat exchanger are made of copper, but on the other hand, the end plates are made of steel plates. Therefore, galvanic corrosion occurs because of the contact of the dissimilar metals with each other, but when the electrochemical potentials of the ionization tendencies are compared between copper and steel, the electrochemical potential of the ionization tendency of copper is at the plus side with respect to that of steel. Therefore, the tubes made of copper do not corrode in the galvanic corrosion, and moreover, the electric field corrosion of the end plates made of steel plates do not degrade the specification (durable years) of the condenser (external heat exchanger).

By the way, in a case an aluminum condenser where tubes and fins of the condenser (external heat exchanger) are made of aluminum (aluminum external heat exchanger) is employed in order to reduce the weight and improve the heat exchange efficiency, and the condenser is attached to the attachment base with the end plates made of steel plates as in the past, the aluminum tubes are dissolved due to galvanic corrosion because of the contact between the dissimilar metals, which results in leakage of the refrigerant. This is because when the electrochemical potentials of the ionization tendencies are compared between aluminum and steel, the electrochemical potential of the ionization tendency of aluminum is at the negative side with respect to that of steel, and accordingly, galvanic corrosion occurs at the aluminum side. Therefore, in a case where the aluminum condenser is employed, the end plates made of steel plates cannot be used. In other words, the condenser cannot be attached to the attachment base by using the end plates. In addition, since the attachment base is also made of steel plate, there is a problem in that the aluminum condenser is required to be installed without bringing the aluminum condenser into contact with the attachment base.

The present invention is made in view of the above issues, and it is an object of the present invention to solve the above problem, and to provide a vending machine, wherein even in a case where an aluminum external heat exchanger is employed as an external heat exchanger, the external heat exchanger can be installed on an attachment base made of steel plate with a simple configuration.

SUMMARY OF THE INVENTION

To achieve the above object, a first aspect of the present invention provides a vending machine in which a refrigeration cycle is constituted by an internal heat exchanger installed in a product accommodation chamber inside of a vending machine main body formed as a heat-insulated housing, an external heat exchanger installed in a machine chamber of the vending machine main body, and a compressor. In the vending machine, the external heat exchanger and the compressor are provided on a base of the vending machine main body with an attachment base made of a steel plate interposed therebetween, and the external heat exchanger is made of aluminum. The vending machine includes a pair of right and left holding members made of synthetic resin engaged with and fixed to the attachment base and having an accommodation unit corresponding to an outer shape at both sides of a lower portion of the aluminum external heat exchanger. The pair of right and left holding members forms a gap between the aluminum external heat exchanger and the attachment base such that both sides of the lower portion of the aluminum external heat exchanger are accommodated and held in the accommodation unit.

Further, a second aspect of the present invention provides the vending machine according to the first aspect, wherein in the aluminum external heat exchanger, a flat tube forming a meandering refrigerant flow path and connected to an inlet header and an outlet header provided at one side in a right/left direction and a corrugated fin adhered to a horizontally extending portion of the flat tube and having a width protruding in a forward/backward direction from a horizontally extending portion of the flat tube are made of aluminum. The accommodation units of the pair of right and left holding members accommodate and carry the flat fin protruding in the forward/backward direction from the horizontally extending portion of the flat tube.

Further, in a third aspect of the present invention according to the first aspect, the vending machine further includes a wind tunnel made of a steel plate such that the wind tunnel covers the aluminum external heat exchanger, and the wind tunnel includes a shield unit shielding a flow of wind to right and left end portions which are portions of hairpin-shaped bent portions formed in connection with the horizontally extending portion of the flat tube.

In the vending machine according to the first aspect of the present invention, a refrigeration cycle is constituted by the internal heat exchanger installed in the product accommodation chamber inside of the vending machine main body 1 formed as a heat-insulated housing, the external heat exchanger installed in a machine chamber of the vending machine main body, and the compressor. In the vending machine, the external heat exchanger and the compressor are provided on a base of the vending machine main body with an attachment base made of a steel plate interposed therebetween, the external heat exchanger is made of aluminum. The vending machine includes a pair of right and left holding members made of synthetic resin engaged with and fixed to the attachment base having accommodation units corresponding to an outer shape at both sides of a lower portion of the aluminum external heat exchanger. The pair of right and left holding members forms a gap between the aluminum external heat exchanger and the attachment base such that both sides of the lower portion of the aluminum external heat exchanger are accommodated and held in the accommodation unit thereof, so that with the pair of right and left holding members made of synthetic resin, the aluminum external heat exchanger can be installed with a space apart from the steel plate attachment base. Therefore, the aluminum external heat exchanger can be installed on the attachment base while preventing galvanic corrosion due to contact between dissimilar metals with each other. In addition, the holding members are formed as the pair separated into the right and the left, so that the cost of the materials can be greatly reduced as compared with the holding member for separating the external heat exchanger made of aluminum and the attachment base made of steel plate and having the same size as the projected area of the bottom portion of the aluminum external heat exchanger. Thus, the increase in cost can be reduced to the minimum.

DETAILED DESCRIPTION OF THE INVENTION

Figure 7:
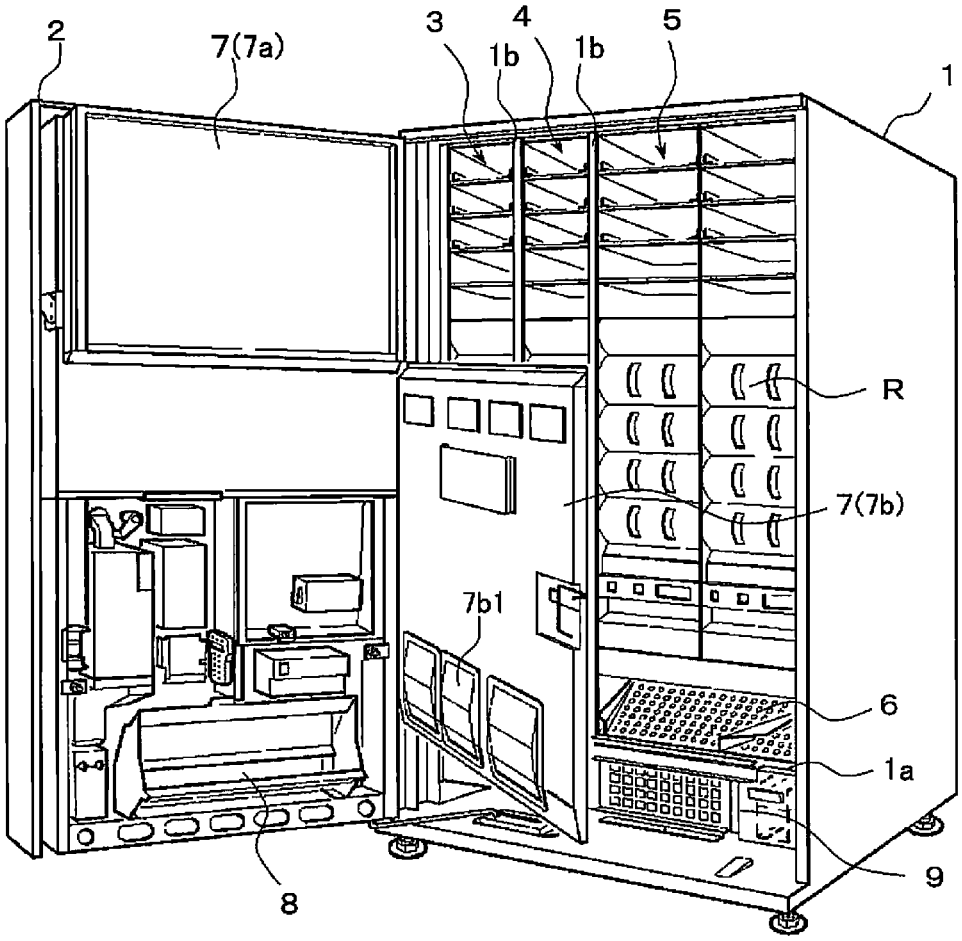
FIG. 7 is a perspective view illustrating an outer door open state of a vending machine to which the present invention relates.

A vending machine according to an embodiment of the present invention will be hereinafter explained in details with reference to drawings. It should be noted that the overall configuration of the vending machine is the same as the configuration as shown in FIG. 7. Therefore, repeated explanations about the vending machine according to the present embodiment are not be made, and the vending machine according to the present embodiment is explained as necessary with reference to FIG. 7.

Figure 1:
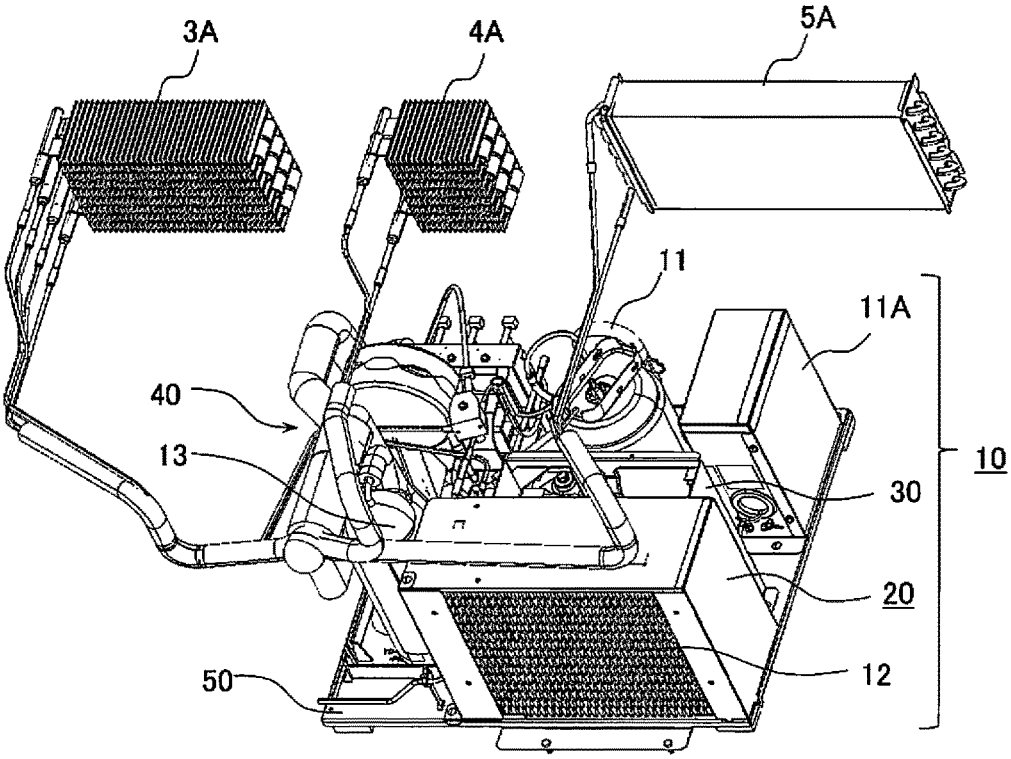
FIG. 1 is a diagram illustrating a refrigeration cycle of a vending machine according to an embodiment of the present invention.
Figure 2:
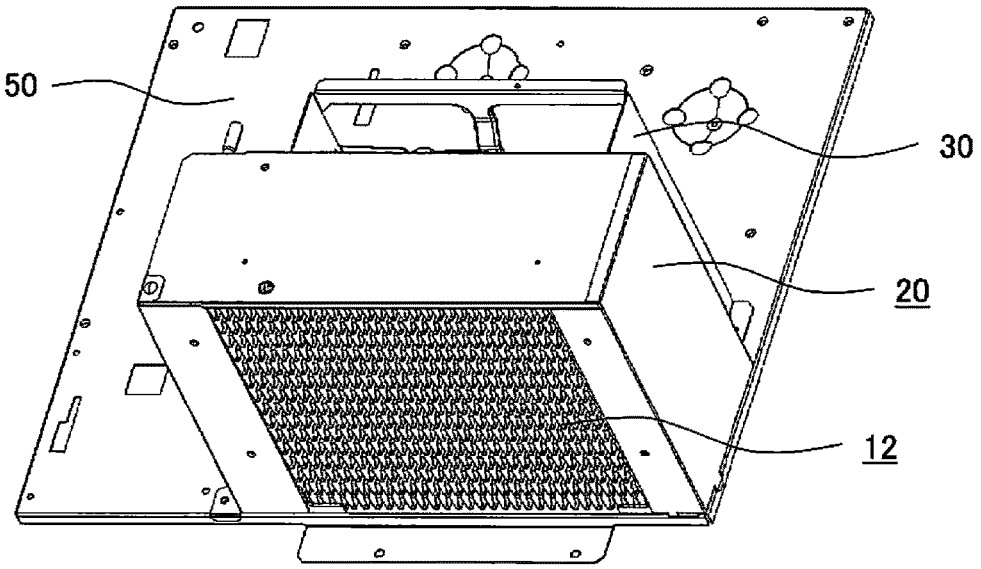
FIG. 2 is a perspective view illustrating an attachment state of an aluminum external heat exchanger of FIG. 1.

FIG. 1 is a diagram illustrating a refrigeration cycle of a vending machine according to an embodiment of the present invention. In FIG. 1, reference numeral 10 denotes a condensing unit of a refrigerator. This condensing unit 10 includes not only a compressor 11, an aluminum condenser (aluminum external heat exchanger) 12 covered with a wind tunnel 20, a gas liquid separation device 13, and an external fan 14 (see FIG. 3) attached to a fan motor attachment member 30, but also a distribution unit 40 arranged with an expansion valve, a distribution device, a solenoid valve, and the like, which are not shown, and is connected to internal heat exchangers 3A, 4A, 5A installed in a product accommodation chamber (for example, product accommodation chambers 3 to 5 as shown in FIG. 7) via individual pipes from the distribution unit 40. It should be noted that reference numeral 11A denotes a control box including an inverter control circuit substrate controlling the rotation and driving of the compressor 11.

As is well known, the condensing unit 10 and the internal heat exchangers 3A, 4A, 5A constitute a refrigeration cycle in which a high temperature refrigerant gas compressed by the compressor 11 is provided via the solenoid valve to the aluminum condenser 12, and is condensed by the aluminum condenser (aluminum external heat exchanger) 12, and the refrigerant made into liquid refrigerant is expanded by the expansion valve and made into a gas-liquid two-phase flow, and thereafter, the gas-liquid two-phase flow is provided to the internal heat exchangers 3A, 4A, 5A via a solenoid valve that is different from the distribution device, and the gas-liquid two-phase flows that are evaporated and gasified by the internal heat exchangers 3A, 4A, 5A are separated into gas and liquid by the gas liquid separation device 13, and the gas and the liquid is returned back to the compressor 11. It should be noted that the internal heat exchangers 3A, 4A are made of heat exchangers in which refrigerant flow paths are formed with flat tubes. On the other hand, the internal heat exchanger 5A is made of a fin-and-tube heat exchanger. This shows an example where the internal heat exchanger 3A includes two sets of refrigerant flow paths independent from each other, and is used as an evaporator or a condenser.

Figure 3:
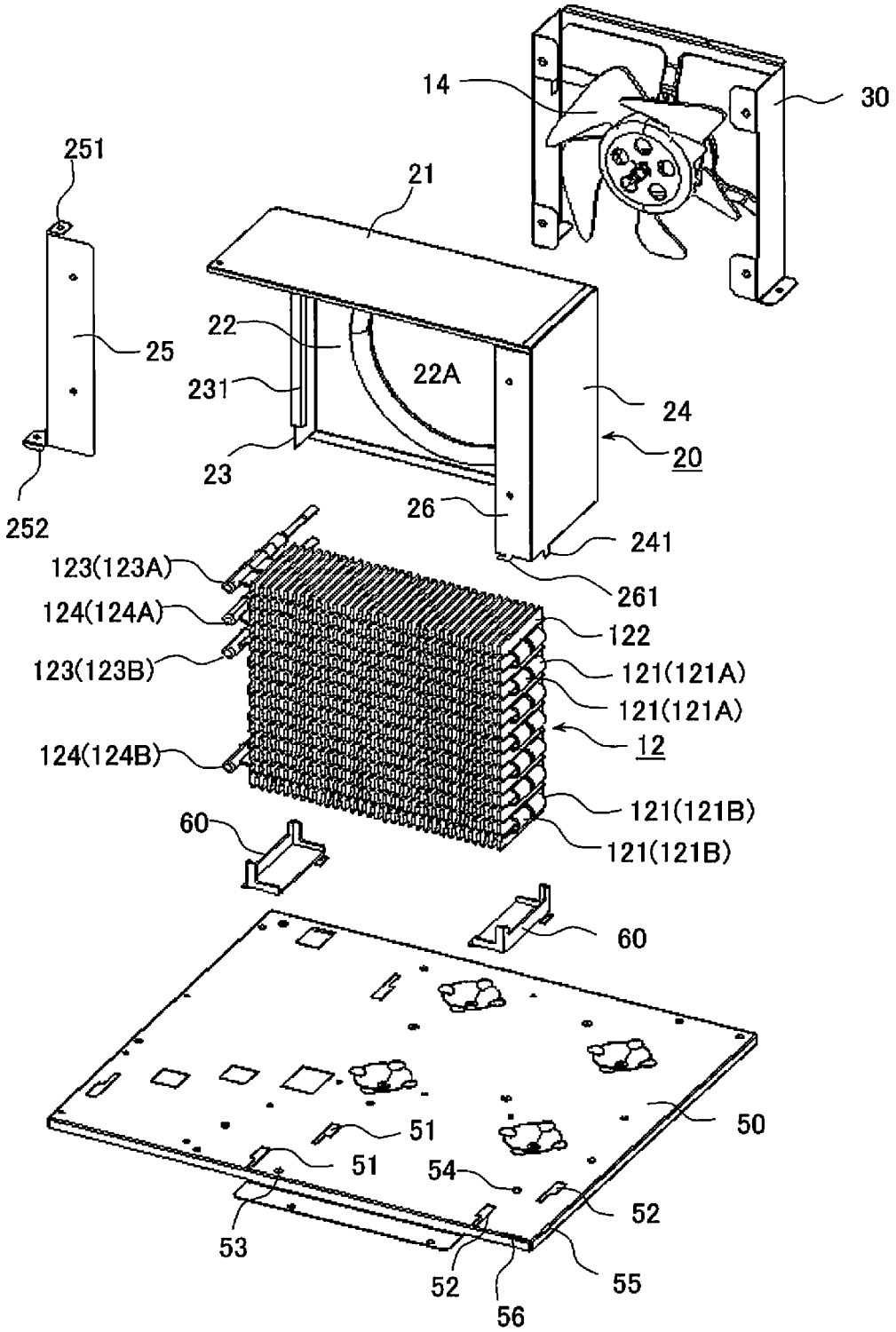
FIG. 3 is an exploded view of FIG. 2.

The condensing unit 10 of the refrigerator is fixed and attached to the attachment base 50 provided on the base which forms the bottom portion of the machine chamber 9 of the vending machine main body 1 (see FIG. 7). As shown in FIG. 3, this attachment base 50 is made of a thin box-shape steel plate and has a pair of engagement holes 51, 52 which are formed at the front and the back sides at each of the forward-side central portion and the right end of the rectangular flat plate surface. Each of these engagement holes 51, 52 is made by connecting a thin groove having a narrow width and a thick groove having a wide width, and the engagement holes 51, 52 which make the pairs at the front and the back sides are provided at different positions in the right/left direction. Fitting holes 53, 54 are drilled and formed in proximity to the pair of engagement holes 51, 52 at the front and the backsides. The pair of engagement holes 51, 52 at the front and the back sides and the fitting holes 53, 54 are provided to attach holding members 60, 60 to install the aluminum condenser (aluminum external heat exchanger) 12 on the attachment base 50. Long and narrow slits 55, 56 are provided at edge portions in proximity to the right corner at the forward-side of the attachment base 50, and these slits 55, 56 are provided to attach the wind tunnel 20. Not only the engagement holes 51, 52 and the fitting holes 53, 54 but also holes and the like are drilled and provided as necessary in the flat plate surface of the attachment base 50 in order to attach components such as the compressor 11, the distribution unit 40, and the like. The attachment of the aluminum condenser (aluminum external heat exchanger) 12 and the wind tunnel 20 to the attachment base 50 will be explained later.

Figure 4A:
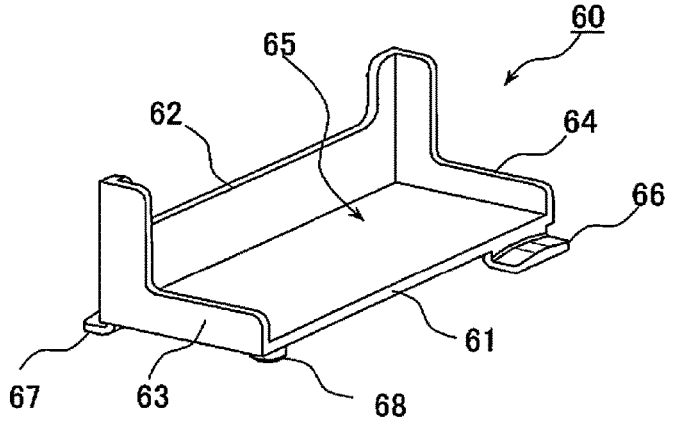
FIGS. 4(*a*) and 4(*b*) illustrate a holding member of the aluminum external heat exchanger as shown in FIG. 2, wherein FIG. 4(*a*) is a perspective view thereof, and FIG. 4(*b*) is a perspective view illustrating an important portion when the holding member is engaged with an fixed to the attachment base.
Figure 4B:
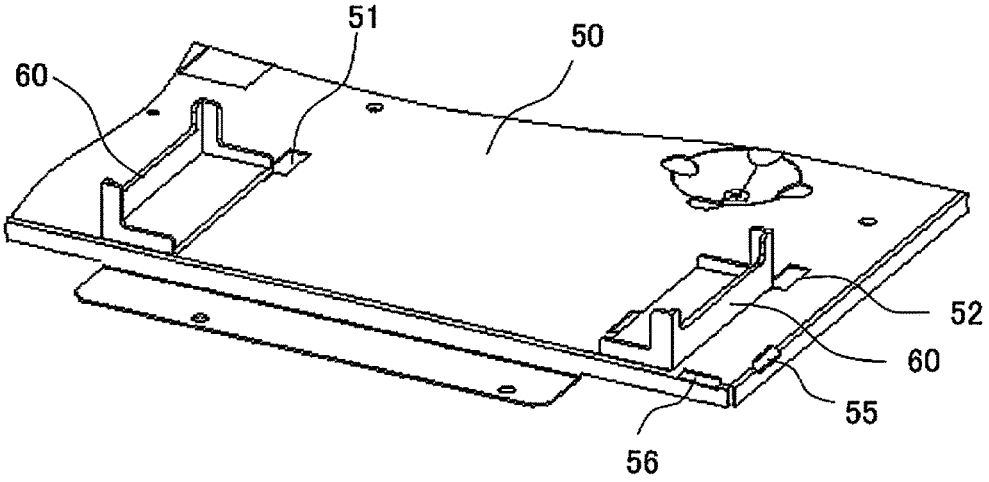

As shown in FIGS. 3 and 4(*a*), 4(*b*), the aluminum condenser (aluminum external heat exchanger) 12 (hereinafter simply referred to as the condenser 12) is constituted by a flat tube 121 and a corrugated fin 122, and the flat tube 121 and the corrugated fin 122 are made of aluminum. In the flat tube 121, the meandering refrigerant flow path is formed by horizontally extending portions extending in the right/left direction and hairpin-shaped bent portions formed in connection with the horizontally extending portions. The corrugated fin 122 is adhered to the horizontally extending portion of the flat tube 121, and the corrugated fin 122 has such a width as to protrude in the forward/backward direction from the horizontally extending portion of the tube 121 of which width in forward/backward direction is flat. It should be noted that the undulating shape of the corrugated fin 122 is made into a trapezoid, and the flat portion which is the upper side of the trapezoid is adhered to the horizontally extending portion of the flat tube 121.

The flat tube 121 is connected to an inlet header 123 and an outlet header 124 provided at one side in the right/left direction, i.e., the left side of the condenser 12 in this embodiment. In this embodiment, a flat tube 121A at the upper stage side is connected to an inlet header 123A and an outlet header 124A, and the flat tube 121B at the lower stage side is connected to an inlet header 123B and an outlet header 124B, so that two sets of independent refrigerant flow paths are formed. In this case, in a case where the internal heat exchangers 3A, 4A as shown in FIG. 1 are installed in the product accommodation chambers 3, 4 (see FIG. 7) which are hot/cold switchable chambers, and the internal heat exchanger 5A (see FIG. 7) is installed in the product accommodation chamber 5 (see FIG. 7) which is the cold-only chamber, the inlet header 123A and the outlet header 124A of the condenser 12 are connected to the refrigerant pipes of the heat exchangers 3A, 4A, and the inlet header 123B and the outlet header 124B of the condenser 12 are connected to the refrigerant pipe of the internal heat exchanger 5A. In this case, the distribution unit 40 is provided with a refrigerant switch circuit for switching the flow of the refrigerant to the internal heat exchanger 3A as follows. More specifically, one of the refrigerant flow paths is a circuit of a cold operation mode for passing the refrigerant from the compressor 11 through the inlet header 123A and the outlet header 124A of the condenser 12 via one of the refrigerant flow paths of the internal heat exchanger 3A back to the compressor 11, and the other thereof is a circuit of a hot operation mode for passing the refrigerant from the compressor 11 through the other of the refrigerant paths of the internal heat exchanger 3A via the inlet header 123B and the outlet header 124B of the condenser 12 back to the compressor 11. Therefore, in a case of the circuit of the cold operation mode, the internal heat exchanger 3A functions as an evaporator, and in the case of the circuit of the hot operation mode, the internal heat exchanger 3A functions as a condenser.

By the way, the condenser 12 is installed on the attachment base 50 with the pair of right and left holding members 60, 60. The pair of right and left holding members 60, 60 is made of components of the same shapes. The holding member 60 at the left side in FIG. 3 is shown in FIGS. 4 A and 4B as a representative. This holding member 60 is a molding of synthetic resin (for example, polypropylene), and is formed with an accommodation unit 65 including a bottom wall 61, an external side wall 62, a front wall 63, and a rear wall 64. The front wall 63 and the rear wall 64 may be formed in a rectangular shape, but in order to save the cost of the material, the front wall 63 and the rear wall 64 are cut to be in an L shape. The reason why the external side wall 62 is cut in a recessed shape is to pass the flat tube 121B that forms the refrigerant flow path of the condenser 12. The space enclosed by the bottom wall 61, the external side wall 62, the front wall 63, and the rear wall 64 is formed as the accommodation unit 65 in the form corresponding to the outer shape at both sides of the lower portion of the condenser 12. The outer shape at both sides of the lower portion of the condenser 12 is an outer shape at both sides of the lower portion of the corrugated fin 122 protruding in the forward/backward direction from the horizontally extending portion of the flat tube 121B at the lower stage side.

L-shaped engagement claws 66, 67 are formed in proximity to the rear portion at the inner side and in proximity to the front portion of the outer side of the bottom wall 61 of the holding member 60. The L-shaped engagement claws 66, 67 include a base unit extending from the bottom plate 61 to the lower side and a hook unit protruding from the base unit to the inner side and the outer side. The hook units of these engagement pieces 66, 67 are located at the position lower than the bottom wall 61. A cylindrical protrusion 68 protruding to the lower side is formed in proximity to the front portion of the inner side of the back surface of the bottom plate 61. A bulging unit bulging in the forward/backward direction so as to protrude to the upper side is formed on the hook unit of the engagement claws 66, 67. The height of the bulging unit is substantially the same as the height of the protrusion 68.

The holding member 60 is attached to the pair of front and rear engagement holes 51 (see FIG. 3) provided in the attachment base 50 as follows. More specifically, while the bottom wall 61 of the holding member 60 is positioned in parallel with the surface of the attachment base 50, the engagement claws 66, 67 formed in proximity to the rear portion at the inner side and in proximity to the front portion of the outer side of the holding member 60 are fit in the thick grooves of the pair of front and rear engagement holes 51 of the attachment base 50. In this case, the thick grooves of the pair of front and rear engagement holes 51 are formed to be larger than the hook units of the engagement claws 66, 67, and the hook units of the engagement claws 66, 67 are formed at the position lower than the bottom plate 61. Therefore, the hook units of the engagement claws 66, 67 pass through the thick grooves of the pair of front and rear engagement holes 51 and reach the position lower than the back surface of the attachment base 50, but do not completely penetrate therethrough. This is because the protrusion 68 is provided on the back surface of the bottom wall 61, and when the protrusion 68 contacts the flat plate surface of the attachment base 50, portions in proximity to the front and back edge portions of the hook units of the engagement claws 66, 67 drop below the back surface of the attachment base 50, and on the other hand, the bulging units which protrude to the upper side of the hook units remain in the thick grooves of the pair of front and rear engagement holes 51. In this state, the base units of the engagement claws 66, 67 contact the groove edges of the pair of front and rear engagement holes 51.

When the holding member 60 slides to the front in this state, the base units of the engagement claws 66, 67 enter into the thin grooves of the pair of front and rear engagement holes 51 (the width of the thin groove is defined to be a width slightly larger than the thickness of the base units of the engagement claws 66, 67), and on the other hand, the front edges of the hook units of the engagement claws 66, 67 get under the back surface of the attachment base 50. While the holding member 60 are slid and moved to the front, the bulging units bent so as to protrude upward which are formed on the hook units of the engagement claws 66, 67 contact the groove edges of the thick grooves of the pair of front and rear engagement holes 51. In this case, the engagement claws 66, 67, which are moldings of synthetic resin, allow the bulging units of the hook units to deform so as to get under the back surface of the attachment base 50, thus allowing the holding member 60 to move forward. When the protrusion 68 provided on the bottom portion 61 of the holding member 60 reaches the fitting hole 53 of the attachment base 50, the protrusion 68 fits in the fitting hole 53 with the help of the resilience force of the deformed engagement claws 66, 67. Accordingly, the back surface of the bottom wall 61 of the holding member 60 comes into close contact with the flat plate surface of the attachment base 50, and the holding member 60 is engaged with and fixed to the attachment base 50 while the protrusion 68 restricts movement in the forward/backward direction, and the base units of the engagement claws 66, 67 restrict movement in the right/left direction, and the hook units of the engagement claws 66, 67 restrict movement in the upward/downward direction. The right holding member 60 of the pair of right and left holding members 60, 60 as shown in FIG. 3 is made by rotating a member having the same configuration as the left holding member 60 for 180 degrees, and the right holding member 60 is engaged with the pair of front and back engagement holes 52 and the fitting hole 54 provided in the attachment base 50, so that the right holding member 60 is installed on the attachment base 50 (see FIG. 4(*b*)).

Figure 5:
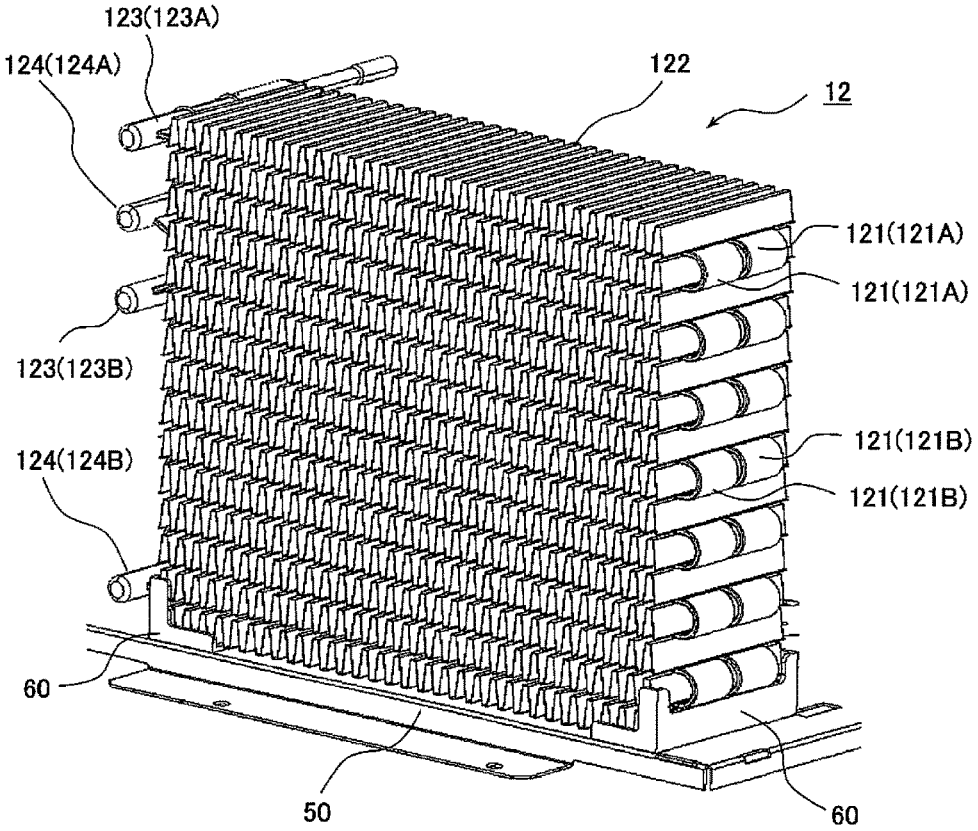
FIG. 5 is a perspective view illustrating an installation state in which the aluminum external heat exchanger of FIG. 1 is installed to the attachment base.

The condenser 12 is attached to the pair of right and left holding members 60, 60 installed on the attachment base 50 as follows. More specifically, the condenser 12 is placed on the pair of right and left holding members 60, 60 in such a manner that the corrugated fins 122 at both sides of the lower portion of the condenser 12 are accommodated in the accommodation units 65, 65 of the pair of right and left holding members 60, 60 installed on the attachment base 50 (see FIG. 5). In this case, the external side walls 62, 62 of the pair of right and left holding members 60, 60 are further cut in a recessed shape to serve as the path of the tube 121B for forming the refrigerant flow path so as not to contact the tube 121B, and therefore, the tube 121B does not contact the external side walls 62, 62 and break the external side walls 62, 62. As described above, while the corrugated fins 122 at both sides of the lower portion of the condenser 12 are placed on the accommodation units 65, 65 of the pair of right and left holding members 60, 60, the outermost corrugated fins 122 come into contact with the external side walls 62, 62 of the pair of right and left holding members 60, 60, which restricts movement in the right/left direction, and the front and rear edges of multiple corrugated fins 122 at both sides of the lower portion of the condenser 12 come to contact with the front wall 63 and the rear wall 64 of the pair of right and left holding members 60, 60, which restricts movement in the forward/backward direction, and a gap is formed between the lowermost fin 122 of the condenser 12 and the flat plate surface of the attachment base 50. As described above, the aluminum fins 122 can be installed in such a manner that the aluminum fins 122 are spaced apart from the steel plate attachment base 50. Therefore, the aluminum external heat exchanger can be engaged with and fixed to the attachment base while preventing galvanic corrosion caused by the contact between the dissimilar metals. Since corrugated fins 122 in multiple stages provided in the vertical direction are adhered to the flat tubes 121 and are integrated, the load (weight) associated with multiple corrugated fins 122 at both sides of the lower portion of the condenser 12 placed on the accommodation units 65, 65 of the pair of right and left holding members 60, 60 is distributed among the entire condenser 12. Therefore, the load would not concentrate on the portion, and would not deform the corrugated fins 122.

Figure 6:
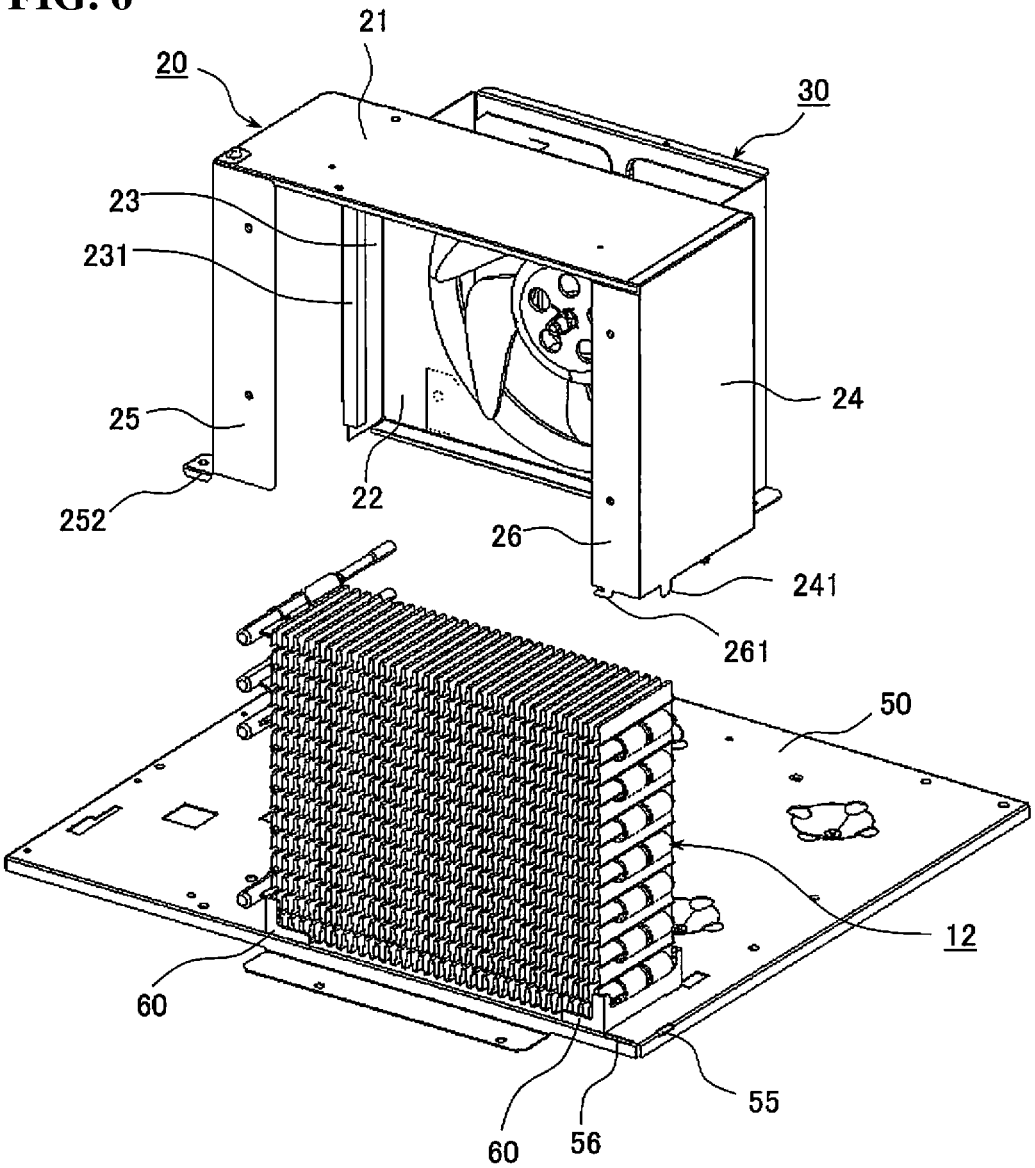
FIG. 6 is an exploded view illustrating a state in which a wind tunnel is attached to the aluminum external heat exchanger of FIG. 5.

Subsequently, the wind tunnel 20 covering the condenser 12 engaged with and fixed to the attachment base 50 is made of a steel plate as described above, and as shown in FIGS. 3 and 6, the wind tunnel 20 includes a top plate 21, a back plate 22, right and left side plates 23, 24, and right and left shield covers 25, 26. In this embodiment, the top plate 21, the back plate 22, the right side plate 24, and the right side shield cover 26 are integrally formed of a single steel plate, and on the other hand, the shield cover 25 is separately formed as a separate component. The projected area of each of the top plate 21 and the right side plate 24 is formed to be larger than the projected area of the condenser 12, and in a case where the top plate 21 is the upper/lower surface, and the right side plate 24 is the left/right surface, the virtual space enclosed by the upper/lower surface and the left/right surface is formed to be larger than the contour of the condenser 12.

The back plate 22 is provided with a fan opening 22A (see FIG. 3) to which the fan motor attachment member 30 is fixed and which is provided with the external fan 14 attached to the fan motor attachment member 30. The left side plate 23 is integrally provided with the back plate 22, and is formed to be narrower than the right side plate 24. This left side plate 23 is formed at one side of the condenser 12 in the right/left direction. In this embodiment, the left side plate 23 is formed by bending the back plate 22 so that the left side plate 23 is located at the inside of the inlet header 123 and the outlet header 124 arranged at the left side of the condenser 12. A cushion 231 is attached to the front end of the left side plate 23.

The right side plate 24 is integrally provided with the shield cover 26, which is made through bending. This shield cover 26 is provided to shield some of the wind (right end portion) passing through the wind tunnel 20, and more specifically, the shield cover 26 is provided to shield the wind passing through an area corresponding to the hairpin-shaped bent portion at the right end side of the flat tube 121 forming the meandering refrigerant flow path of the condenser 12. A hook piece 261 extending to the lower side and facing the left hand side is formed at the lower portion of the shield cover 26. A stopper 241 extending to the lower side is formed at the lower portion in proximity to the front of the right side plate 24.

The shield cover 25 is provided to shield some of the wind (left end portion) passing through the wind tunnel 20, and more specifically, the shield cover 25 is provided to shield the wind passing through an area corresponding to the hairpin-shaped bent portion at the left end side of the flat tube 121 forming the meandering refrigerant flow path of the condenser 12. Attachment pieces 251, 252, which are made through bending, are formed at the end portions of the shield cover 25 in the vertical direction, and screw insertion holes are formed in the attachment pieces 251, 252.

This wind tunnel 20 is attached to the attachment base 50 after the fan motor attachment member 30 is fixed to the back plate 22 with screws. More specifically, the wind tunnel 20 is attached to cover the condenser 12 from above the condenser 12 (see FIG. 6) installed on the attachment base 50 with the pair of right and left holding members 60, 60. In this case, the left side plate 23 integrally provided with the back plate 22 covers the condenser 12 in such a manner that the left side plate 23 is inserted between the inlet header 123, the outlet header 124, and the fins 122 protruding to the rear from the horizontally extending portion of the flat tube 121 of condenser 12. Then, while the stopper 241 formed at the lower portion of the right side plate 24 and the hook piece 261 formed at the lower portion of the shield cover 26 are opposed to the slits 55, 56 formed at the edge portion in proximity to the forward-side right corner of the attachment base 50, the stopper 241 and the hook piece 261 are inserted into the slits 55, 56 of the attachment base 50, and thereafter, the wind tunnel 20 is slid in the left direction, and the hook piece 261 is engaged with the attachment base 50, so that the movement of the wind tunnel 20 to the upper side is restricted. In this case, the lateral width of the slit 55 is defined to have a size that does not obstruct slide movement in the left direction in order to engage the hook piece 261 with the attachment base 50, and when the hook piece 261 is engaged with the attachment base 50, the stopper 241 contacts the left edge of the slit 55, and restricts movement of the wind tunnel 20 in the left direction. Then, after the shield cover 25 is arranged at the forward-side left corner of the top plate 21, the attachment piece 251 is fixed to the top plate 21 with a screw, and the attachment piece 252 is fixed to the attachment base 50 with a screw. Accordingly, the wind tunnel 20 is fixed to the attachment base 50 in such a manner that the wind tunnel 20 covers the condenser 12. It should be noted that the fan motor attachment member 30 fixed to the back plate 22 with screws is fixed to the attachment base 50 with screws, so that the wind tunnel 20 is fixed still more rigidly.

As described above, the wind tunnel 20 attached to the attachment base 50 is arranged to be spaced apart from the condenser 12, and galvanic corrosion does not occur due to the contact of dissimilar metals. With the right and left shield covers 25, 26, the wind of the external fan 14 can blow to the area of the corrugated fins 122 in a concentrated manner. Therefore, the heat exchange efficiency of the condenser 12 can be improved. Then, the cushion 231 attached to the front end of the left side plate 23 of the wind tunnel 20 has a function of preventing the left side plate 23 from contacting the tubes 121 connected to the inlet header 123 and the outlet header 124 of the condenser 12, and has a function of preventing the wind of the external fan 14 from escaping to the outside of the fins 122 at the left side. It should be noted that a cushion can also be attached to the back surface of the top plate 21 to prevent contact with the uppermost fin 122 of the condenser 12.

As described above, in the vending machine according to the embodiment, a refrigeration cycle is formed by the internal heat exchangers 3A, 4A, 5A installed in the product accommodation chambers 3, 4, 5 inside of the vending machine main body 1 formed as the heat-insulated housing, the external heat exchanger 12 installed in the machine chamber 9 of the vending machine main body 1, and the compressor 11, wherein in the vending machine according to the embodiment, the external heat exchanger 12 and the compressor 11 are provided on the base of the vending machine main body 1 with the steel plate attachment base 50 interposed therebetween, and the external heat exchanger 12 is made of aluminum, and the vending machine includes the accommodation unit 65 corresponding to the outer shape at both sides of the lower portion of the aluminum external heat exchanger 12, and the vending machine includes the pair of right and left holding members 60, 60 made of synthetic resin engaged with and fixed to the attachment base 50, and the pair of right and left holding members 60, 60 form a gap between the aluminum external heat exchanger 12 and the attachment base 50 in such a state that both sides of the lower portion of the aluminum external heat exchanger 12 are accommodated and held in the accommodation units 65, 65 thereof, and with the pair of right and left holding members 60, 60 made of synthetic resin, the aluminum external heat exchanger 12 can be installed to be spaced apart from the steel plate attachment base 50. Therefore, the aluminum external heat exchanger 12 can be installed on the attachment base 50 while preventing galvanic corrosion due to contact between dissimilar metals with each other. In addition, the holding members 60, 60 are formed as the pair separated into the right and the left, so that the cost of the materials can be greatly reduced as compared with the holding member 60 for separating the external heat exchanger 12 made of aluminum and the attachment base 50 made of steel plate and having the same size as the projected area of the bottom portion of the aluminum external heat exchanger 12, and the increase of the cost can be reduced to the minimum. Since the holding member 60 made of synthetic resin is interposed between the external heat exchanger 12 made of aluminum and the attachment base 50 made of steel plate, abrasion and damages of the external heat exchanger 12 made of aluminum and the attachment base 50 made of steel plate can be prevented from being abraded and damaged. In addition, the vibration during cooling unit operation can be alleviated, which can also reduce the noise level.

In the embodiment explained above, the narrow left side plate 23 of the wind tunnel 20 has been explained. However, the left side plate 23 may be of the same size as the right side plate 24, and in this case, cutouts in the vertical direction into which the flat tubes 121 connected to the inlet header 123 and the outlet header 124 are inserted may be formed in the left side plate 23. In this case, the shield cover 25 may be integrally formed with the left side plate 23. The present invention is not limited to the embodiment.

The present invention is based on and claims priority of Japanese Patent Application No. 2015-096642 filed on May 11, 2015, the disclosure of which is incorporated herein.

REFERENCE SIGNS LIST

1 . . . vending machine main body, 3, 4, 5 . . . product accommodation chamber, 3A, 4A, 5A . . . internal heat exchanger, 10 . . . condensing unit, 11 . . . compressor, 12 . . . aluminum condenser (aluminum external heat exchanger), 14 . . . external fan, 20 . . . wind tunnel, 50 . . . attachment base, 60 . . . holding member, 65 . . . accommodation unit, 121 . . . flat tube, 122 . . . corrugated fin, 123 . . . inlet header, 124 . . . outlet header

What is claimed is:

1. A vending machine comprising:

a vending machine main body formed as a heat-insulated housing, and having a product accommodation chamber, a machine chamber and a base, an internal heat exchanger installed in the product accommodation chamber, an external heat exchanger made of aluminum and installed in the machine chamber of the vending machine main body, the aluminum external heat exchanger including a flat tube forming a refrigerant flow path, and a corrugated fin adhered to the flat tube, a compressor installed in the machine chamber and forming a refrigeration cycle together with the internal heat exchanger and the aluminum external heat exchanger, an attachment base made of a steel plate and disposed on the base, the aluminum external heat exchanger and the compressor being provided on the attachment base, and a pair of right and left holding members made of synthetic resin and engaging with and fixing to the attachment base, each having an accommodation unit corresponding to an outer shape at two sides of a lower portion of the aluminum external heat exchanger, each of the accommodation units including a bottom wall arranged between the aluminum external heat exchanger and the attachment base, front and rear walls arranged along front and rear edges of the bottom wall, respectively, the front and rear walls of each of the accommodation units contacting front and rear edges of the corrugated fin of the aluminum external heat exchanger, and an external side wall extending from the bottom wall and connecting the front and rear walls of each of the accommodation units, the external side wall having a recessed portion to receive the flat tube without contacting the flat tube, wherein the pair of right and left holding members forms a gap between the aluminum external heat exchanger and the attachment base such that the two sides of the lower portion of the aluminum external heat exchanger are accommodated and held in the accommodation units.

2. The vending machine according to claim 1, wherein the flat tube is connected to an inlet header and an outlet header provided at one side of the aluminum external heat exchanger in a right-left direction of the aluminum external heat exchanger, the corrugated fin is adhered to a horizontally extending portion of the flat tube and has a width protruding in a forward-backward direction from the horizontally extending portion of the flat tube, the flat tube and the outlet header being made of aluminum, and the accommodation units of the pair of right and left holding members accommodate and carry a flat fin protruding in the forward-backward direction from the horizontally extending portion of the flat tube.

3. The vending machine according to claim 1, further comprising a wind tunnel made of a steel plate and covering the aluminum external heat exchanger, the wind tunnel having a shield unit shielding a flow of wind to right and left end portions which are portions of hairpin-shaped bent portions formed following a horizontally extending portion of the flat tube.

4. The vending machine according to claim 1, wherein each holding member of the pair of right and left holding members further comprises an engagement claw having a base portion extending from the bottom wall toward the attachment base and a hook unit protruding from the base portion to attach to the attachment base, and a protrusion protruding from the bottom wall toward the attachment base, the attachment base includes engagement holes receiving the engagement claws of the holding members, and fitting holes receiving the protrusions of the holding members, and when the pair of right and left holding members is attached to the attachment base, the base portions of the pair of right and left holding members extend through the corresponding engagement holes so that the bottom walls and the hook units of the pair of right and left holding members sandwich the attachment base, respectively, and the protrusions of the pair of right and left holding members are fit into the corresponding fitting holes, respectively.

5. The vending machine according to claim 4, wherein each of the external side walls of the pair of right and left holding members is cut to form the recessed portion as a path for the flat tube.

* * * * *